US005836028A

United States Patent [19]

Petersen

[11] Patent Number: 5,836,028

[45] Date of Patent: Nov. 17, 1998

[54] CURB-CROSSING APPARATUS

[76] Inventor: Gunner Petersen, 6 Sweet Way, Poughquag, N.Y. 12570

[21] Appl. No.: 724,066

[22] Filed: Sep. 30, 1996

[51] Int. Cl.[6] ..... E01D 15/12

[52] U.S. Cl. ..... 14/2.4; 14/69.5; 254/88

[58] Field of Search ..... 14/69.5, 71.1, 14/2.4; 254/88; 414/537; D34/32

[56] References Cited

U.S. PATENT DOCUMENTS

| | | | |
|---|---|---|---|
| 1,384,114 | 7/1921 | Arnold . | |
| 2,759,207 | 8/1956 | Pennington | 14/69.5 |
| 3,164,965 | 1/1965 | Martin | 14/69.5 X |
| 3,315,292 | 4/1967 | Collins . | |
| 3,756,440 | 9/1973 | Raap et al. . | |
| 3,818,528 | 6/1974 | Petersen | 414/537 X |
| 3,863,895 | 2/1975 | Grewe et al. | 14/69.5 X |
| 3,866,771 | 2/1975 | Reid et al. | 414/537 |
| 3,984,891 | 10/1976 | Weinmann | 14/69.5 |
| 4,443,905 | 4/1984 | Kopp . | |
| 4,450,598 | 5/1984 | Larsen | 14/71.1 |
| 4,986,405 | 1/1991 | Alten | 14/69.5 X |
| 5,446,937 | 9/1995 | Haskins . | |

FOREIGN PATENT DOCUMENTS

| | | | |
|---|---|---|---|
| 512117 | 7/1952 | Belgium | 254/88 |

*Primary Examiner*—James Lisehora
*Attorney, Agent, or Firm*—Baker & Botts, L.L.P.

[57] ABSTRACT

A curb crossing apparatus having a pivot member and a ramp member for preventing damage to a curb and equipment upon the equipment's transport between a street and elevated subgrade.

45 Claims, 2 Drawing Sheets

CURB-CROSSING APPARATUS

BACKGROUND OF THE INVENTION

Where roadways or parking lots are built, curbs are usually installed shortly thereafter. Curbs serve to keep peripheral soil from eroding and define the parameters of the road or lot. Because the curbing is normally installed long before the construction project is completed, contractors are often faced with the problem of how to traverse the curbs with their heavy equipment without damaging the curb (for which they may be liable) or their equipment (such as transmissions, drive trains and steering linkages).

Typically, contractors have used wood blocks or boards to fashion a means for crossing curbs. These configurations, while suitable for lighter equipment, do not provide adequate support for substantially heavy trucks or tractors. The wood, if laid across the curb in a ramp-like fashion, tends to break under the pressure of the heavy equipment. This could lead to damage to either the equipment or the curb. Where a wood block is placed on the road or lot against the curb, the block may also rupture. Furthermore, the wood block does not protect the curb from the weight of the equipment. Thus, the curb may be damaged even if the block remains intact as the equipment crosses it.

Besides the use of wood boards or blocks, other devices have been used to facilitate the crossing of curbs. In U.S. Pat. No. 1,384,114, granted Jul. 12, 1921 to Arnold, a dual ramp system utilizing inclined planes that negotiate the change in elevation between the road and the curb is disclosed. The "portable runway" is adapted to be readily positioned adjacent a curbstone when unfolded. Two bridge members (inclined planes) are connected together by two spacing arms that permit folding and storage. The bridge members are disclosed to be, preferably, made of wood to support an automobile.

There are several disadvantages to using the device disclosed in Arnold. First, while the spacing arms are slotted to allow for adjusting the space between the bridge members, the device requires the tires of the automobile to fit on the bridge members for proper curb crossing. In the event that the bridge members' size cannot support the vehicle's tire size, the device cannot be utilized.

Second, the folding capability of the disclosed ramp system is inconsistent with the accommodation of substantially heavy vehicles or loads. This device, like the wood block, will only take the equipment to the top of the curb, not over it. Thus, the curb, at some point in time, will be subject to the full weight of the equipment and may crumble.

Finally, this device, as disclosed, has a sheer, smooth surface which does not provide for adequate vehicle traction. Thus, a heavy load may not only damage the curb, it may slide off the ramps and become damaged itself.

U.S. Pat. No. 3,315,292, granted Oct. 7, 1964 to Collins, discloses a portable ramp adapted to be positioned adjacent a curb to facilitate the movement of a loaded hand truck thereover. The ramp is similar to the wood block/wood board concept and has similar disadvantages.

Because the ramp disclosed in Collins is also manufactured to be easily portable, its ability to support large vehicular loads is compromised. Furthermore, like the device in Arnold, the ramp only brings a load to the top of the curb, where the weight is borne by the curbstone which may, thus, crumble. Also, the sheer surface of the ramp provides no traction features to stabilize the load as it travels thereon.

Finally, in U.S. Pat. No. 5,446,937, granted Sep. 5, 1995 to Haskins, a modular ramp system designed to facilitate passage of wheelchairs or other wheeled vehicles through doorways and other entrance ways having offsets is disclosed. The modular nature of this ramp system makes it incapable of handling heavy loads. Any substantial vehicular weight would cause the separate modules to collapse or become damaged. Furthermore, the design provides that the full weight of the load would be applied to the curb corner as well as the curb surface at some point in time, so that the curb could be damaged upon crossing.

Thus, an object of this invention is to provide a curb crossing device which can support heavy equipment of any wheel base or tire size, provide adequate traction, and prevent the application of the equipment's weight to the curb.

SUMMARY OF THE INVENTION

The present invention overcomes the prior art limitations by providing a curb crossing apparatus for preventing damage to a curb and equipment upon the equipment's transport between a street (or lot) and an elevated subgrade. The curb crossing apparatus includes a pivot member and a ramp member. Preferably, the pivot member is a circular tube. The ramp member has a lower section transversely affixed to the pivot member and an upper section angled from the lower section toward the subgrade. Thus, as equipment traverses the curb crossing apparatus, the apparatus pivots about the pivot member between a first position in which the lower portion of the ramp member makes contact with the street and a second position in which the upper portion of the ramp member rests upon the elevated subgrade. As a result, no weight is applied to the curb corner or surface so that the danger of damage to the curb or equipment is eliminated.

Alternatively, the curb crossing apparatus preferably includes two or more ramp members affixed to the pivot member. This reduces the weight of the apparatus, thus increasing its portability.

Also, the ramp members, preferably, each have an upper arm and a lower arm forming an acute angle at an angle point. The upper arm has a lower section transversely affixed to the pivot member and an upper section angled from the lower section toward the subgrade. The lower arm has its end distal from the angle point affixed to the pivot member. This embodiment provides greater support for heavier loads.

It is preferable to include at least one support member affixed either to the lower section or between and to the upper arm and lower arm of each ramp member, depending on the embodiment. The support members are, preferably, v-shaped having two angle-forming sections to provide the greatest support with the least additional weight, and preferably, are positioned transversely of the ramp member (s).

Preferably, the curb crossing apparatus also includes two or more traction members affixed, preferably, in a parallel fashion, and preferably, transverse to the ramp member(s). The traction members are, preferably, v-shaped having two angle-forming sections affixed to the lower section or upper arm of the ramp member(s).

It is also preferable for the curb crossing apparatus to include at least one support rib having a first edge affixed to the lower section or upper arm of each ramp member and a second edge affixed to the pivot member. The support rib is also, preferably, positioned transversely of the ramp member (s).

Finally, it is preferable for the curb crossing apparatus to include a subgrade resting member affixed beneath and to the end of the upper section of each ramp member. This provides further support and structure so that the apparatus more efficiently clears the curb upon pivoting. The subgrade resting member is, preferably, transverse to the ramp member(s) and formed as a rectangular or circular tube.

BRIEF DESCRIPTION OF THE DRAWING

Further objects, features and advantages of the invention will become apparent from the following detailed description taken in conjunction with the accompanying figures in which.

Figure 1:
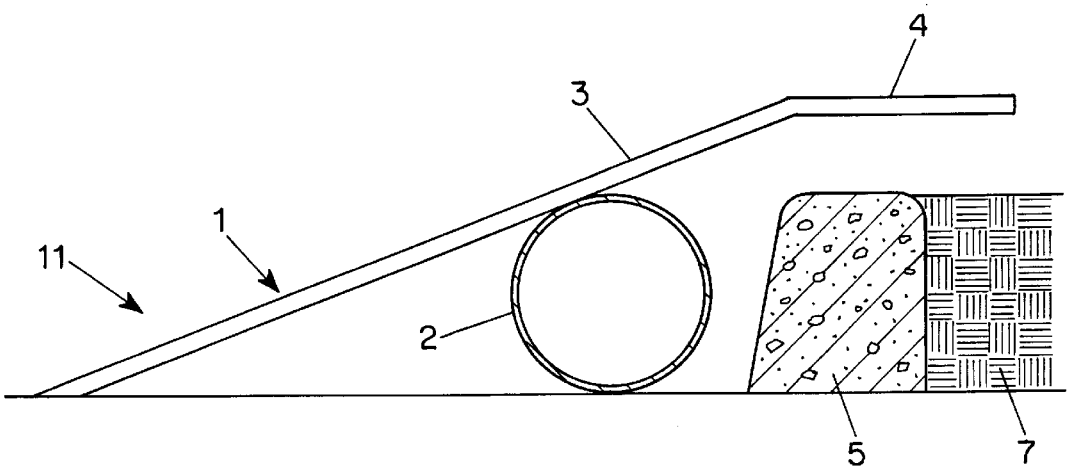
FIG. 1 is a cross-sectional view of a curb crossing apparatus in position for use in accordance with the invention.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with preferred embodiments. It is intended that changes and modifications can be made to the described embodiments without departing from the true scope and spirit of the subject invention as defined by the appended claims.

DETAILED DESCRIPTION

An embodiment of the curb crossing apparatus 11 is simply shown in FIG. 1 as including a ramp member 1 and a pivot member 2. The pivot member is, preferably, an elongated circular tube with a length sufficient to accommodate an individual wheel or an entire wheel base of a vehicle. The ramp member 1, which preferably extends the length of the pivot member, has a lower section 3 which is transversely affixed to the pivot member 2 and an upper section 4 which extends over the curb 5 and subgrade 7 when properly positioned for use, as shown. The upper section 4 is angled from the lower section 3 downward toward the subgrade 7 so that, when a vehicle or load (not shown) traverses the curb 5, the ramp member 1 pivots between a resting position (as shown) wherein the lower section 3 touches the street or ground and the upper section 4 is elevated above the curb 5, and a second position wherein the lower section 3 is elevated above the street or ground and the upper section 4 makes contact with the subgrade 7. This allows the vehicle or load to cross the curb 5 without ever applying possibly damaging weight to the curb 5. In other words, the weight of the vehicle or load is always applied to either the street or ground, the apparatus 11 or the subgrade 7.

Figure 3:
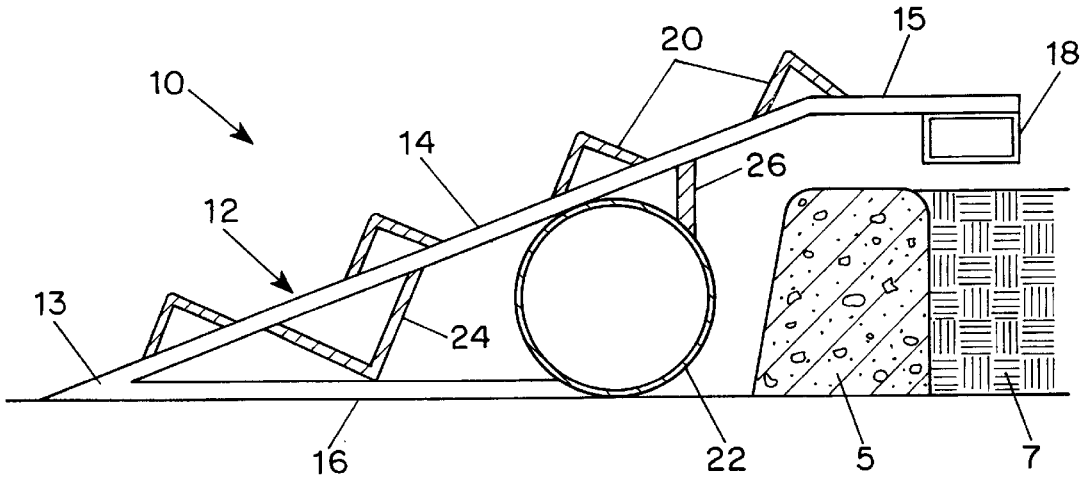
FIG. 3 is a cross-sectional view of the curb crossing apparatus in position for use taken along the lines 3—3 of FIG. 2.
Figure 2:
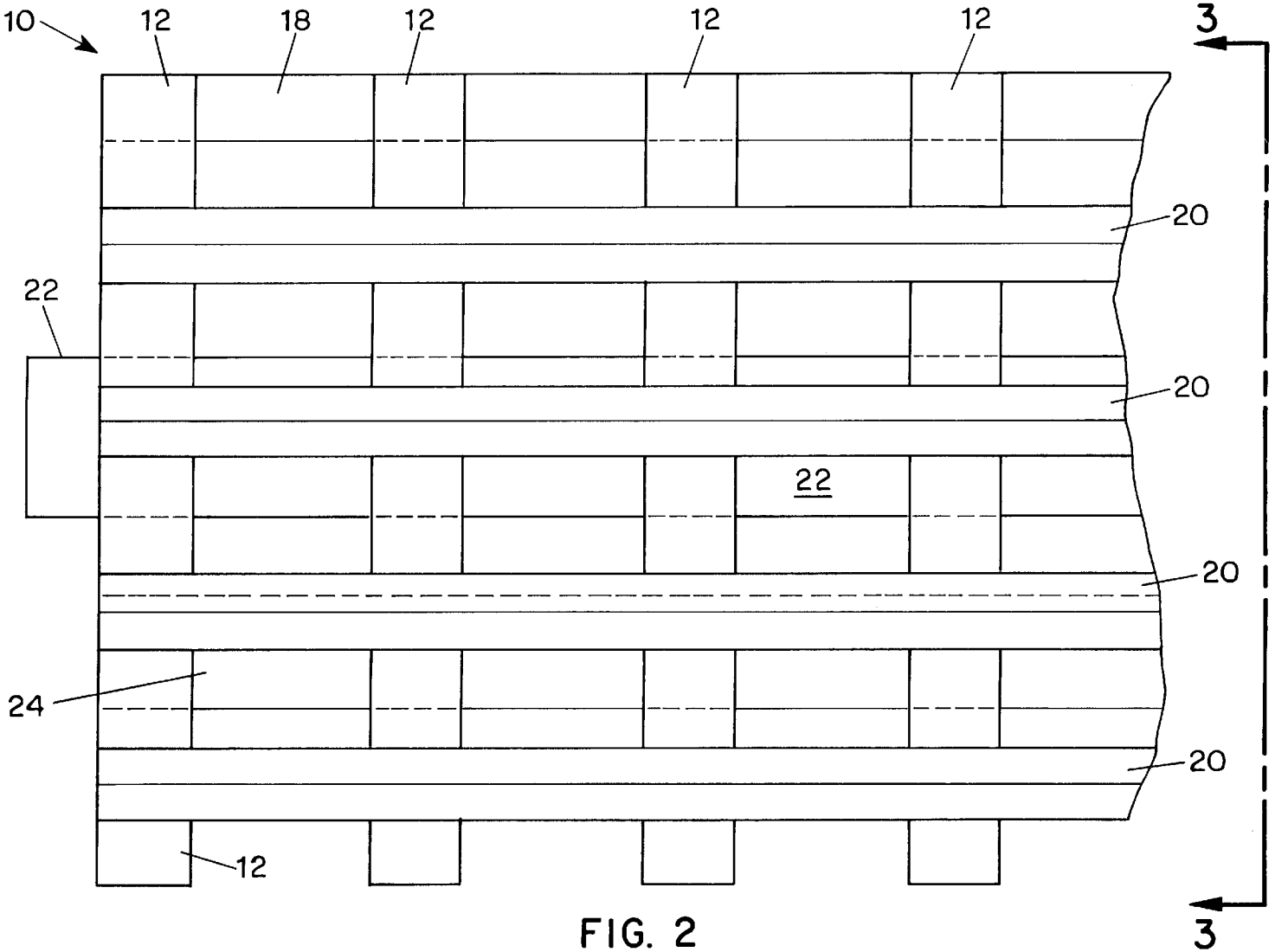
FIG. 2 is a top plan view of a curb crossing apparatus in accordance with a preferred embodiment of the invention.

FIGS. 2 and 3 illustrate a preferred embodiment of the present invention. Although the curb crossing apparatus 10 may include only one ramp member 12, it is preferable to provide, as shown, two or more ramp members 12 that are spaced apart in the transverse direction to reduce the weight of the apparatus 10. As shown in the cross-sectional view of FIG. 3, each ramp member 12 preferably has an upper arm 14 and a lower arm 16 joined at an angle point 13. The upper arm and lower arm form an acute angle such that when the apparatus is resting on the street beside a curb 5, the upper arm 14 extends above the curb. The upper arm has a terminal end portion 15 which, when the apparatus is at rest, is angled toward the ground so that it is preferably parallel to the subgrade 7. Preferably affixed to the bottom side of the terminal end portion 15 is a subgrade resting member 18. The subgrade resting member 18 is preferably a rectangular tube; however, it may take other suitable forms. In the rest position, as shown in FIG. 3, the subgrade resting member 18 is positioned above the subgrade 7. Traction members 20 are preferably affixed, preferably in a transverse direction, as shown in FIG. 2, across each of the upper arms 14 to provide traction for the vehicle or load. The traction members are preferably v-shaped having two angle-forming sections affixed to the upper arms 14, as shown in FIG. 3, but may take other suitable flat or vault forms. The upper arms 14 and the lower arms 16 are affixed to a pivot member 22, as shown in FIG. 3. The pivot member 22 is preferably a circular tube, however it may take some other form that permits it to act as a pivot point or fulcrum. The pivot member 22 allows the apparatus 10 to pivot, as a vehicle or load (not shown) traverses up or down the apparatus 10, between the rest position and a position in which the subgrade resting member 18 abuts the top of the subgrade 7.

To provide additional support to the apparatus 10, at least one support member 24 is preferably affixed between the upper arm 14 and the lower arm 16 of each ramp member 12. Preferably, a single support member 24 extending transversely of the apparatus 10 is used, as shown in FIG. 2 (dotted lines indicating its out of view borders), and is v-shaped having two angle-forming sections, as shown in FIG. 3. However, it may take any form capable of preventing a bending of the upper arm 14 under the stress of heavy equipment.

In the preferred embodiment of FIG. 3, a transversely-extending support rib 26 is shown to be affixed between the upper arm 14 and the pivot member 22. This support rib 26 provides extra support when the weight of the vehicle or load is simultaneously applied to both sides of the upper arm 14 about the pivot member 22. Alternatively, more than one support rib may be used.

The subgrade resting member 18, traction members 20, support member 24 and support rib 26 can also be included in the embodiment shown in FIG. 1. The support member 24, in that embodiment would be affixed to the lower section 3 to provide support between the ramp member 1 and the street or lot. The other elements would be incorporated in the same way as disclosed above.

The dimensions of the apparatus 10 vary according to the elevation of the curb 5. For example, for a curb 5 between five (5) and eight (8) inches high, the following approximate dimensions are preferable. The length of the upper arm 14 is 36.25 in., measured from the angle point 13 along the upper arm to a line extrapolated from the end of the terminal end portion 15 straight up from the ground. The length of the lower arm is 18 in. The acute angle at the angle point 13 between the upper arm 14 and lower arm 16 is 20 degrees. The terminal end portion is 7.5 in. long and the angle between the upper arm 14 and the terminal end portion 15 is 160 degrees. The ramp members 12, as shown in FIG. 2, are 4 in. wide, 0.5 in. deep and separated from each other by 8 in. The width of the subgrade resting member 18 is 3 in., its height is 2 in. and it is formed of 3/16 in. flat material. The diameter of the pivot member 22 is 7 in. and it is formed of 0.25 in. thick round tubing. The pivot member may be any manageable length long enough to support the wheel base of a vehicle. The traction members 20, if angled, have two sides made of 0.5 in. flat material, each of which is 2 in. long.

They are angled so that each traction member 20 covers 3.25 in. of the upper arm 14 with 8 in. separating it from the next traction member. The traction member 20 closest to the angle point between the upper and lower arms is positioned 2.25 in. from the angle point of the upper arm. The traction members 20 are approximately the length of the pivot member 22. The support rib measures 2 in. between the pivot member 22 and the upper arm 14 and is formed of 0.5 in. flat material, running the length of the pivot member 22. Finally, the support member 24 is formed of two sides, each of which is 4 in. long and formed of 0.5 in. flat material. It is positioned so that its angle point is affixed to the lower arm 16 at a position 11 in. from the angle point of the apparatus 10. The support member 24 also runs the length of the pivot member 22.

All the elements of the curb crossing apparatus 10 are, preferably, made of steel except for the pivot member 22 which is preferably made of hot rolled A.S.T.M. A-36. The elements are, preferably, affixed with welding material such as 7014 Electrode, A.W.S. A5.1. Alternatively, the elements may be manufactured with lighter alternatives such as aluminum, high impact polymers, carbon fiber or Kevlar. Other modifications of the invention will occur to those skilled in the art and it is intended that the scope of the invention be limited only as set forth in the appended claims.

I claim:

1. A portable curb crossing apparatus for preventing damage to a curb and equipment upon the equipment's traveling between a street and an elevated subgrade, the apparatus comprising:

a ramp member having a lower section and an upper section angled from the lower section toward the subgrade and having an upper section end distal from the lower section; and a tubular pivot member transversely affixed to the lower section of the ramp and resting, during use, on a surface of the street, the pivot member having a transverse cross-section of a size such that the upper section end is at a height higher than the elevation of the subgrade;

wherein the curb crossing apparatus pivots about the pivot member between a first position in which the lower portion of the ramp member makes contact with the street and a second position in which the upper portion of the ramp member rests upon the elevated subgrade, as the equipment traverses the curb crossing apparatus.

2. The curb crossing apparatus of claim 1 wherein the pivot member is a circular tube.

3. The curb crossing apparatus of claim 1 further comprising at least one support member being affixed to the lower section of the ramp member.

4. The curb crossing apparatus of claim 3 wherein the at least one support member is v-shaped having two angle-forming sections.

5. The curb crossing apparatus of claim 3 wherein the support member is positioned transversely of the ramp member.

6. The curb crossing apparatus of claim 1 further comprising a plurality of spaced traction members affixed to the lower section of the ramp member.

7. The curb crossing apparatus of claim 6 wherein the traction members are parallel to each other.

8. The curb crossing apparatus of claim 6 wherein the traction members are positioned transversely of the ramp member.

9. The curb crossing apparatus of claim 6 wherein each of the traction members is v-shaped having two angle-forming sections affixed to the lower section of the ramp member.

10. The curb crossing apparatus of claim 1 further comprising at least one support rib having a first edge affixed to the lower section of the ramp member and a second edge affixed to the pivot member.

11. The curb crossing apparatus of claim 10 wherein the at least one support rib is positioned transversely of the ramp member.

12. A curb crossing apparatus for preventing damage to a curb and equipment upon the equipment's traveling between a street and an elevated subgrade, the apparatus comprising:

a ramp member having a lower section and an upper section angled from the lower section toward the subgrade and having an upper section end distal from the lower section;

a subgrade resting member affixed beneath and to the upper section end of the ramp member; and a tubular pivot member transversely affixed to the lower section of the ramp and resting, during use, on a surface of the street, the pivot member having a transverse cross-section of a size such that the upper section end is at a height higher than the elevation of the subgrade;

wherein the curb crossing apparatus pivots about the pivot member between a first position in which the lower section of the ramp member makes contact with the street and a second position in which the subgrade resting member rests upon the elevated subgrade, as the equipment traverses the curb crossing apparatus.

13. The curb crossing apparatus of claim 12 wherein the subgrade resting member is positioned transversely of the ramp member.

14. The curb crossing apparatus of claim 12 wherein the subgrade resting member is a rectangular tube.

15. The curb crossing apparatus of claim 12 wherein the pivot member is a circular tube.

16. A curb crossing apparatus for preventing damage to a curb and equipment upon the equipment's traveling between a street and an elevated subgrade, the apparatus comprising:

a plurality of spaced-apart ramp members, each having a lower section and an upper section angled from the lower section toward the subgrade and having an upper section end distal from the lower section;

an elongated tubular pivot member transversely affixed to each lower section and resting, during use, on a surface of the street, the pivot member having a transverse cross-section of a size such that each upper section end is at a height higher than the elevation of the subgrade;

wherein the curb crossing apparatus pivots about the pivot member between a first position in which the lower portion of the ramp member makes contact with the street and a second position in which the upper portion of the ramp members rests upon the elevated subgrade, as the equipment traverses the curb crossing apparatus.

17. The curb crossing apparatus of claim 16 wherein the pivot member is a circular tube.

18. The curb crossing apparatus of claim 16 further comprising at least one support member being affixed to the lower section of each ramp member.

19. The curb crossing apparatus of claim 18 wherein the at least one support member is v-shaped having two angle-forming sections.

20. The curb crossing apparatus of claim 18 wherein the support member is positioned transversely of each ramp member.

21. The curb crossing apparatus of claim 16 further comprising a plurality of spaced traction members affixed to the lower section of each ramp member.

22. The curb crossing apparatus of claim 21 wherein the traction members are parallel to each other.

23. The curb crossing apparatus of claim 21 wherein the traction members are positioned transversely of each ramp member.

24. The curb crossing apparatus of claim 21 wherein each of the traction members is v-shaped having two angle-forming sections affixed to the lower section of each ramp member.

25. The curb crossing apparatus of claim 16 further comprising at least one support rib having a first edge affixed to the lower section of each ramp member and a second edge affixed to the pivot member.

26. The curb crossing apparatus of claim 25 wherein the at least one support rib is positioned transversely of each ramp member.

27. A curb crossing apparatus for preventing damage to a curb and equipment upon the equipment's traveling between a street and an elevated subgrade, the apparatus comprising:

a plurality of ramp members each having a lower section and an upper section angled from the lower section toward the subgrade and having an upper section end distal from the lower section;

a subgrade resting member affixed beneath and to the upper section end of each ramp member;

an elongated tubular pivot member transversely affixed to each lower section and resting, during use, on a surface of the street, the pivot member having a transverse cross-section of a size such that each upper section end is at a height higher than the elevation of the subgrade;

wherein the curb crossing apparatus pivots about the pivot member between a first position in which the lower section of each ramp member makes contact with the street and second position in which the subgrade resting member rests upon the elevated subgrade, as the equipment traverses the curb crossing apparatus.

28. The curb crossing apparatus of claim 27 wherein the subgrade resting member is positioned transversely of each ramp member.

29. The curb crossing apparatus of claim 27 wherein the subgrade resting member is a rectangular tube.

30. The curb crossing apparatus of claim 27 wherein the pivot member is a circular tube.

31. A curb crossing apparatus for preventing damage to a curb and equipment upon the equipment's traveling between a street and an elevated subgrade, the apparatus comprising:

an elongated pivot member and a plurality of ramp members, each having an upper arm and a lower arm forming an acute angle at an angle point; the upper arm having a lower section being transversely affixed to the pivot member and an upper section angled from the lower section toward the subgrade, and the lower arm having a lower arm end distal from the angle point and affixed to the pivot member;

wherein the curb crossing apparatus pivots about the pivot member between a first position in which the lower arm of the ramp member is parallel to and resting upon the street and a second position in which the upper section rests upon the elevated subgrade, as the equipment traverses the curb crossing apparatus.

32. The curb crossing apparatus of claim 31 wherein the pivot member is a circular tube.

33. The curb crossing apparatus of claim 31 further comprising at least one support member being affixed between and to the upper arm and the lower arm of each ramp member.

34. The curb crossing apparatus of claim 33 wherein the at least one support member is v-shaped having two angle-forming sections.

35. The curb crossing apparatus of claim 33 wherein the support member is positioned transversely of each ramp member.

36. The curb crossing apparatus of claim 31 further comprising a plurality of spaced traction members affixed to the upper arm of each ramp member.

37. The curb crossing apparatus of claim 36 wherein the traction members are parallel to each other.

38. The curb crossing apparatus of claim 36 wherein the traction members are positioned transversely of each ramp member.

39. The curb crossing apparatus of claim 36 wherein each of the traction members is v-shaped having two angle-forming sections affixed to the upper arm of each ramp member.

40. The curb crossing apparatus of claim 31 further comprising at least one support rib having a first edge affixed to the upper arm of each ramp member and a second edge affixed to the pivot member.

41. The curb crossing apparatus of claim 40 wherein the at least one support rib is positioned transversely of each ramp member.

42. A curb crossing apparatus for preventing damage to a curb and equipment upon the equipment's traveling between a street and an elevated subgrade, the apparatus comprising:

an elongated pivot member;

a plurality of ramp members, each having an upper arm and a lower arm forming an acute angle at an angle point; the upper arm having a lower section being transversely affixed to the pivot member and an upper section angled from the lower section toward the subgrade and having an upper section end distal from the lower section, the lower arm having a lower arm end distal from the angle point and affixed to the pivot member; and a subgrade resting member affixed beneath and to the upper section end of the upper arm of each ramp member;

wherein the curb crossing apparatus pivots about the pivot member between a first position in which the lower arm of the ramp member is parallel to and resting upon the street and a second position in which the subgrade resting member rests upon the elevated subgrade as the equipment traverses the curb crossing apparatus.

43. The curb crossing apparatus of claim 42 wherein the subgrade resting member is positioned transversely of the ramp members.

44. The curb crossing apparatus of claim 42 wherein the subgrade resting member is a rectangular tube.

45. The curb crossing apparatus of claim 42 wherein the pivot member is a circular tube.

* * * * *